US007441499B2

(12) United States Patent
Eppinger

(10) Patent No.: US 7,441,499 B2
(45) Date of Patent: Oct. 28, 2008

(54) SCREEN PRINTER PRINT ARM

(75) Inventor: Otto Richard Eppinger, Braeside (AU)

(73) Assignee: Reefdale Pty Ltd, Victoria (AU)

( * ) Notice: Subject to any disclaimer, the term of this patent is extended or adjusted under 35 U.S.C. 154(b) by 225 days.

(21) Appl. No.: 11/078,609

(22) Filed: Mar. 14, 2005

(65) Prior Publication Data

US 2005/0252394 A1 Nov. 17, 2005

(30) Foreign Application Priority Data

May 14, 2004 (AU) ..... 2004902538

(51) Int. Cl.
*B30B 9/02* (2006.01)

(52) U.S. Cl. ..... 101/123; 101/126

(58) Field of Classification Search ..... 101/123
See application file for complete search history.

(56) References Cited

U.S. PATENT DOCUMENTS 2,553,085 A * 5/1951 Groce ..... 101/35
3,859,917 A * 1/1975 Bubley et al. ..... 101/123
3,955,501 A * 5/1976 Bubley et al. ..... 101/123
4,084,504 A * 4/1978 Fuchs ..... 101/115
4,964,335 A * 10/1990 Klemm ..... 101/129
5,189,950 A 3/1993 Eppinger
5,419,244 A * 5/1995 Kutman ..... 101/123
5,476,039 A * 12/1995 Hiruta et al. ..... 101/123
5,520,106 A * 5/1996 Karlyn et al. ..... 101/35
5,592,877 A 1/1997 Szyszko et al.
6,105,494 A * 8/2000 Hoffman et al. ..... 101/114
6,152,030 A * 11/2000 Fuqua ..... 101/115
6,164,199 A * 12/2000 Dubuit et al. ..... 101/38.1
6,484,629 B1 * 11/2002 Hoffman et al. ..... 101/44

* cited by examiner

*Primary Examiner*—Jill E Culler
(74) *Attorney, Agent, or Firm*—Connolly Bove Lodge & Hutz LLP

(57) ABSTRACT

A print arm for a screen printing machine of the type having radial print arms and radial pallet arms that rotate relative to the print arms the print arms incorporating a detachable print carriage drive assembly from which the print carriage is suspended the print carriage drive assembly incorporation an electrically driven belt to reciprocate the print carriage and the belt path is horizontal. In one embodiment a print assembly plate is provided as the base for the print carriage support assembly so that all the components are mounted to the plate and the plate can be easily attachable to the print arm. In a second embodiment a channel member is used in conjunction with three mounting plates instead of the one assembly plate.

4 Claims, 7 Drawing Sheets

SCREEN PRINTER PRINT ARM

FIELD OF THE INVENTION

This invention relates to improvements in the print arm and of carousel screen printing machines

BACKGROUND TO THE INVENTION

Carousel Screen printing machines are used for screen printing of garments and utilise a plurality of fixed print heads beneath which are positioned a plurality of garment support pallets which are moveable from one print head to the next. Each print head has a carriage mounted for reciprocal movement to move the flood bar and squeegee bars over the screen.

The flood bar and squeegee blades forming the print head in screen printing machines are mounted on a moving carriage with the flood bar down in the flood stroke and the squeegee down in the print stroke. The carriage is supported at both ends in a print frame and moves back and forth along the print frame.

U.S. Pat. No. 5,189,950 discloses a centrally mounted print arm supporting a central portion of the carriage for reciprocal movement along the print arm. The carriage is pneumatically driven along the arm. An alternative to pneumatic drives is electric motor driven drive belts. U.S. Pat. No. 5,592,877 discloses an electric drive with a the drive belt moving in a vertical plane. To tension the belt an additional adjustable pulley is usually provided.

As the design of the rotary screen printing machines evolve ease of operation and reduction of fabrication costs are of increasing importance. Another desirable attribute is the ease with which screens and print carriage assemblies can be serviced and replaced.

It is an object of this invention to provide a print arm that addresses these needs.

BRIEF DESCRIPTION OF THE INVENTION

To this end the present invention provides a print arm for a screen printing machine of the type having radial print arms and radial pallet arms that rotate relative to the print arms the print arms incorporating a detachable print carriage drive assembly from which the print carriage is suspended the print carriage drive assembly incorporation an electrically driven belt to reciprocate the print carriage wherein the belt path is horizontal.

By having a horizontal belt path the drive pulley can be mounted vertically above or below the electric drive shaft and gear box so that the gear box is contained within the print carriage frame. In a preferred form of the invention, a print assembly plate is provided as the base for the print carriage support assembly so that all the components are mounted to the plate and the plate can be easily attachable to the print arm.

In another aspect the invention provides a print drive assembly for a carousel screen printing machine including a) an upper horizontal assembly plate
b) vertically dependent end plates attached to the assembly plate
c) an electric drive dependent from the assembly plate
d) a drive belt driven by said electric drive and mounted for movement in a plane parallel to the assembly plate.

This assembly plate enables the print drive module with the electric motor to be easily removed from the print arm and replaced if necessary to make maintenance simpler. A print carriage is mounted on the drive belt for reciprocal movement between said end plates. The drive belt is preferably not an endless belt as is conventional but is joined at the free ends by an adjustable clamp located on the print carriage so that the belt can be tensioned without the need for a tensioning pulley.

In a further aspect the invention provides a print drive assembly for a carousel screen printing machine including a) a longitudinal support frame member
b) mounting plates attached to the support frame at each end of the support frame
c) an electric drive dependent from one of said mounting plates
d) a drive belt driven by said electric drive and mounted for horizontal movement around said support frame member.

This provides a less expensive and lighter weight alternative to the assembly plate embodiment without compromising strength or rigidity.

Because the print drive assembly can easily be attached or detached from the print arm, micro registration can be achieved by eccentric spigots attached to the print arm acting on slots in the assembly plate.

In both the embodiments described the print assembly can be easily dismounted from the print arm of the screen printing machine and replaced so that service or maintenance on print arms can be carried out off the screen printing machine and does not interfere with production time.

DETAILED DESCRIPTION OF THE INVENTION

Preferred embodiments of the invention will be described with reference to the drawings in which.

Figure 1:
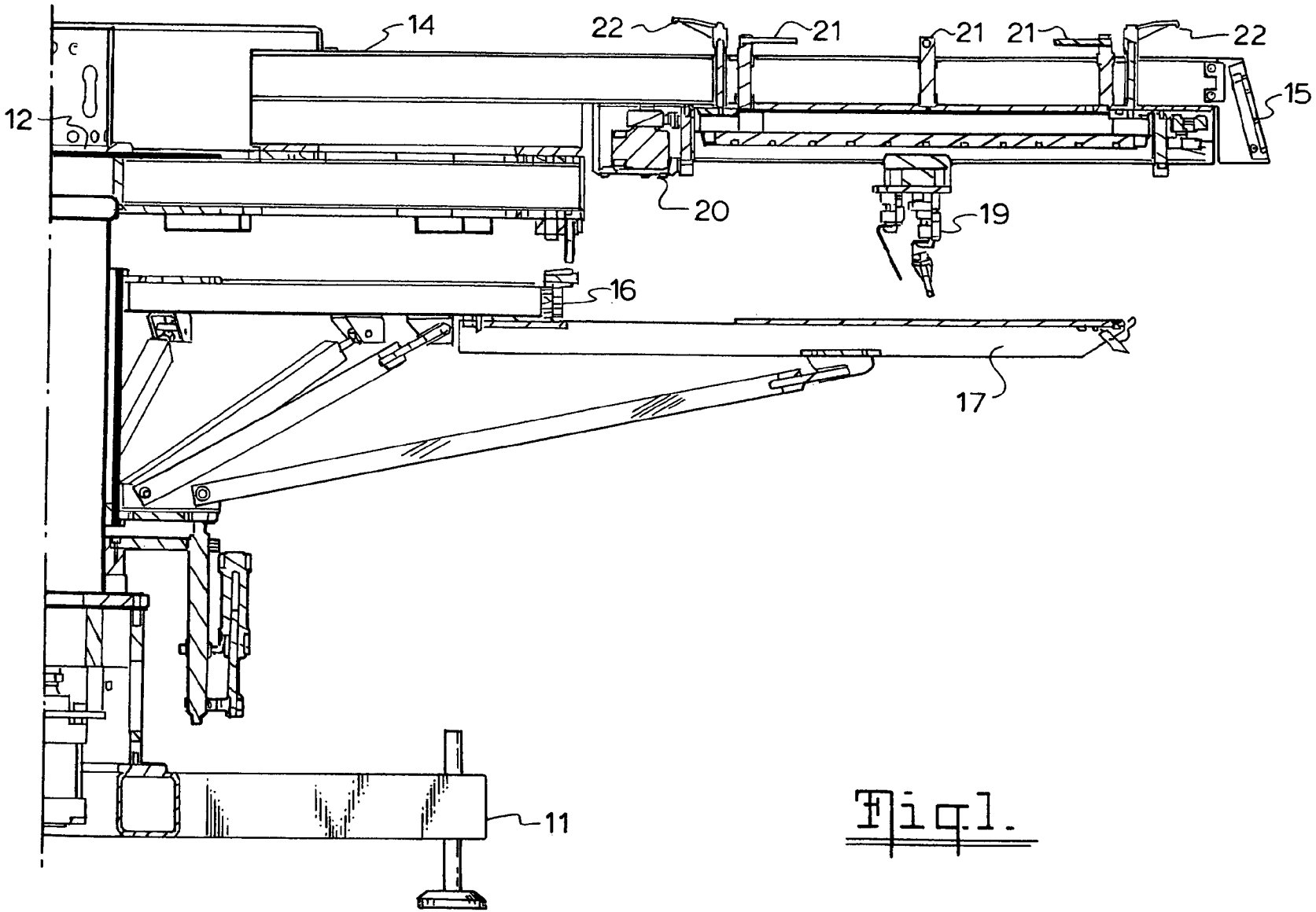
FIG. 1 is a schematic side view of a carousel screen printing machine print and pallet arm arrangement in accordance with one preferred embodiment of this invention.
Figure 2:
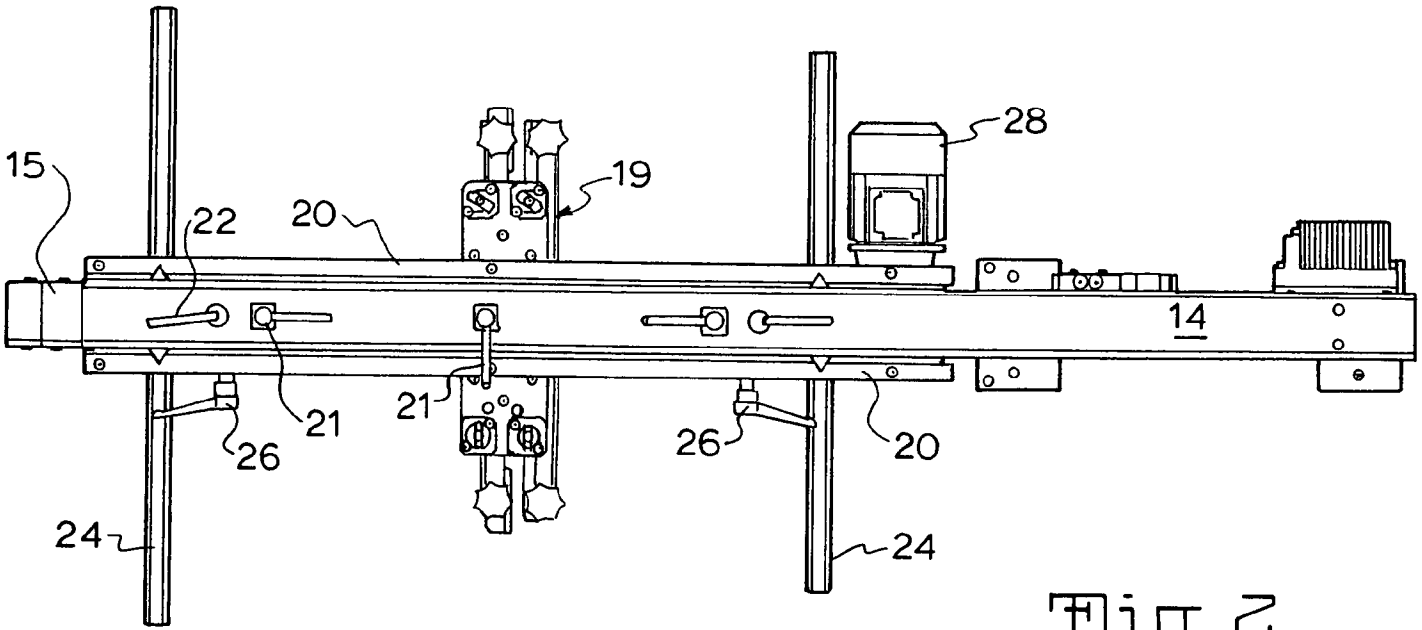
FIG. 2 is a plan view of a print arm according to a preferred embodiment of the invention.
Figure 3:
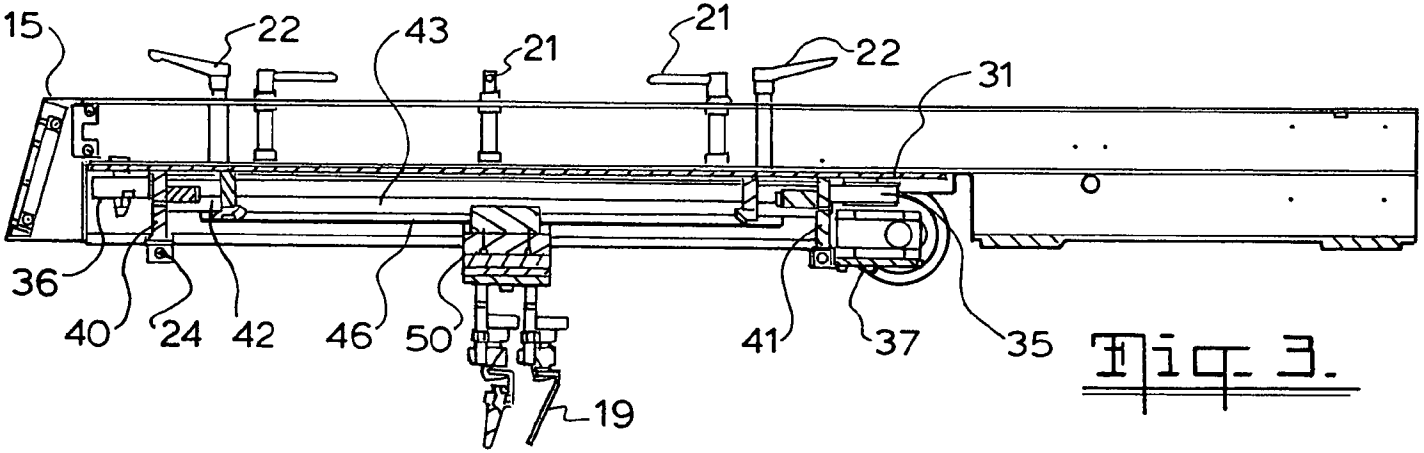
FIG. 3 is a side section view along the line B-B of FIG. 2.
Figure 4:
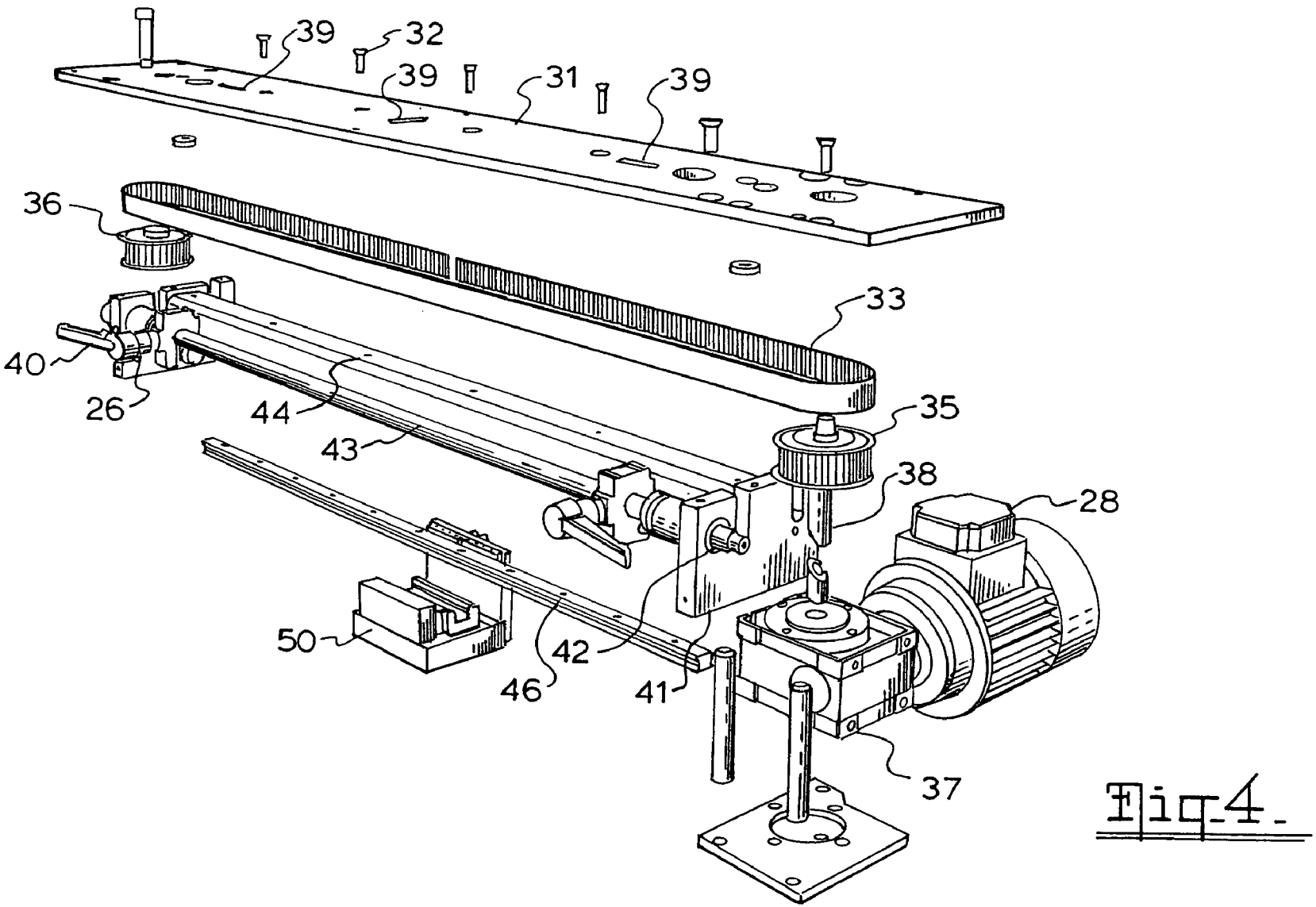
FIG. 4 is a an exploded view of the print carriage drive assembly for the print arm of FIG. 2.
Figure 5:
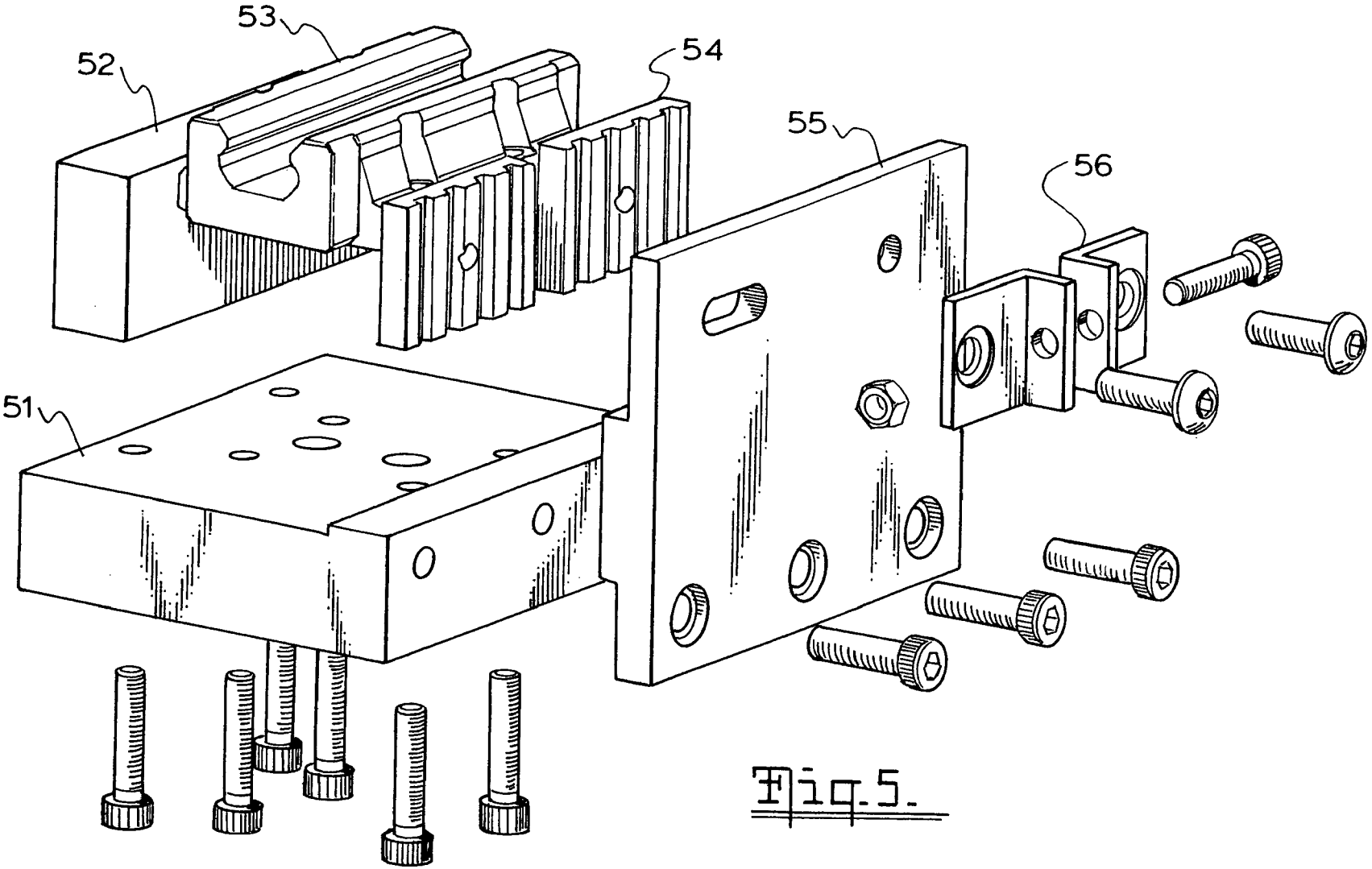
FIG. 5 is an exploded view of the print carriage support shown in FIG. 4.

The screen printing machine has a base 11 a central stator 12 with fixed radial print arms 14 and rotatable pallet arms 16 carrying pallets 17. The print head 19 carries the squeegee and flood bars and in this invention is suspended beneath the print drive assembly 20. A control panel 15 is mounted at the outer end of each print arm. The print arms also carry the screen frame attachments 24. The limit stops for the print carriage are adjusted by moving the stop levers 26 along the trip bar 43 associated with which is a limit switch 42 at the control panel end, that reverses the electric motor and thus reverse the belt 33 to enable the print head 19 to reciprocate between the ends of the printable area of the screen (not shown).

A preferred print drive assembly 20 in accordance with this invention is illustrated in FIGS. 2-5. The drive assembly is attached to the print arm 14 by two attachment bolts 22 which are secured to the print head mount plate 31. The mount plate 31 supports the front print head plate 40 and rear print head plate 41. The front plate 40 and rear plate 41 are also spaced by the rigid bar 44 which provides rigidity to the print head drive assembly. The screen frame attachments 24 are mounted directly onto the front and rear plates 40 and 41. The electric motor 28 and gear box 37 are mounted onto the base plate 31 behind the rear plate 41. The shaft 38 of the gear box 37 carries the drive pulley 35 for the drive belt 33. The idler pulley 36 is mounted in front of the front plate 40 and behind the control panel 15.

Attached to the belt 33 is the print carriage 50 from which the print head 19 is suspended. The carriage 50 reciprocates with the belt 33 along the guide rail 46. The carriage 50 consists of belt clamp plates 54 which attach the ends of the belt 33 to the drive plate 55. The belt tensioner brackets 56 are able to be adjusted by the nut and bolt 57-58. The bolts 59 are able to move in one or more slots in the drive plate 55 to allow the clamp plates 54 and the attached belt 33 to be tightened. This tensioning arrangement is simpler than the usual tensioner pulley arrangements. The drive plate 55 is secured to the print head mounting plate 51 which also carries the trip block 52 which activates the limit switch 42 by hitting the stops 26 and pushing the trip bar 43 to move a cam and actuate the switch 42 into one of two positions to reverse the electric motor. Attached to the trip block 52 is the linear slide 53 which slides along the guide rail 46.

The belt 33 is mounted horizontally and this simplifies the construction of the print drive assembly 20 because the gear box 37 can be mounted in line with the belt rather than externally as is the case with vertically arranged belts. This arrangement allows the print drive assembly with the electric drive components to be easily demounted from the print arm 14 for servicing. In prior art arrangements the drive assembly could not be separated from the print arm.

Figure 6:
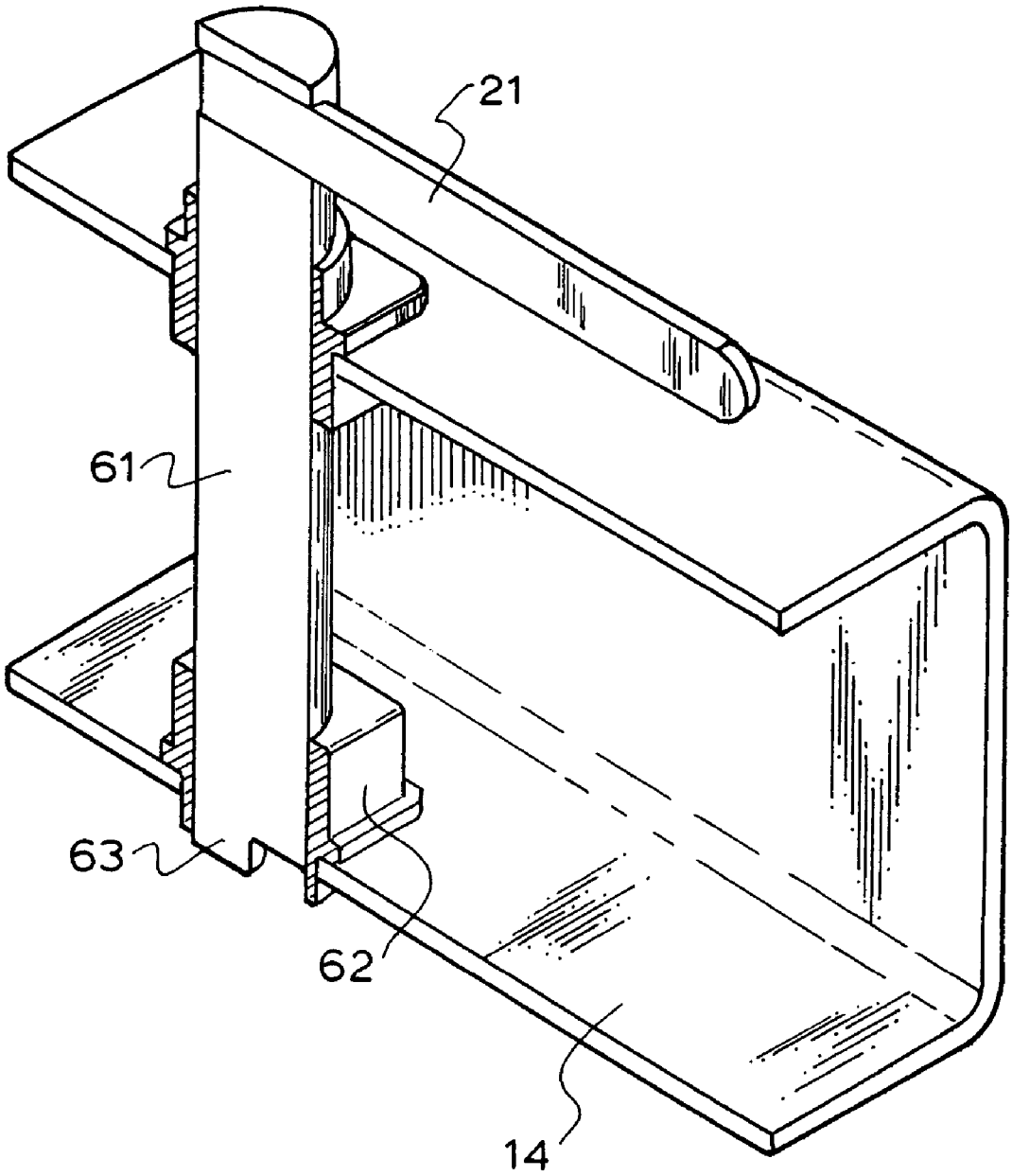
FIG. 6 is a sectional perspective view of a micro registration device for the print arm of FIG. 2.
Figure 7:
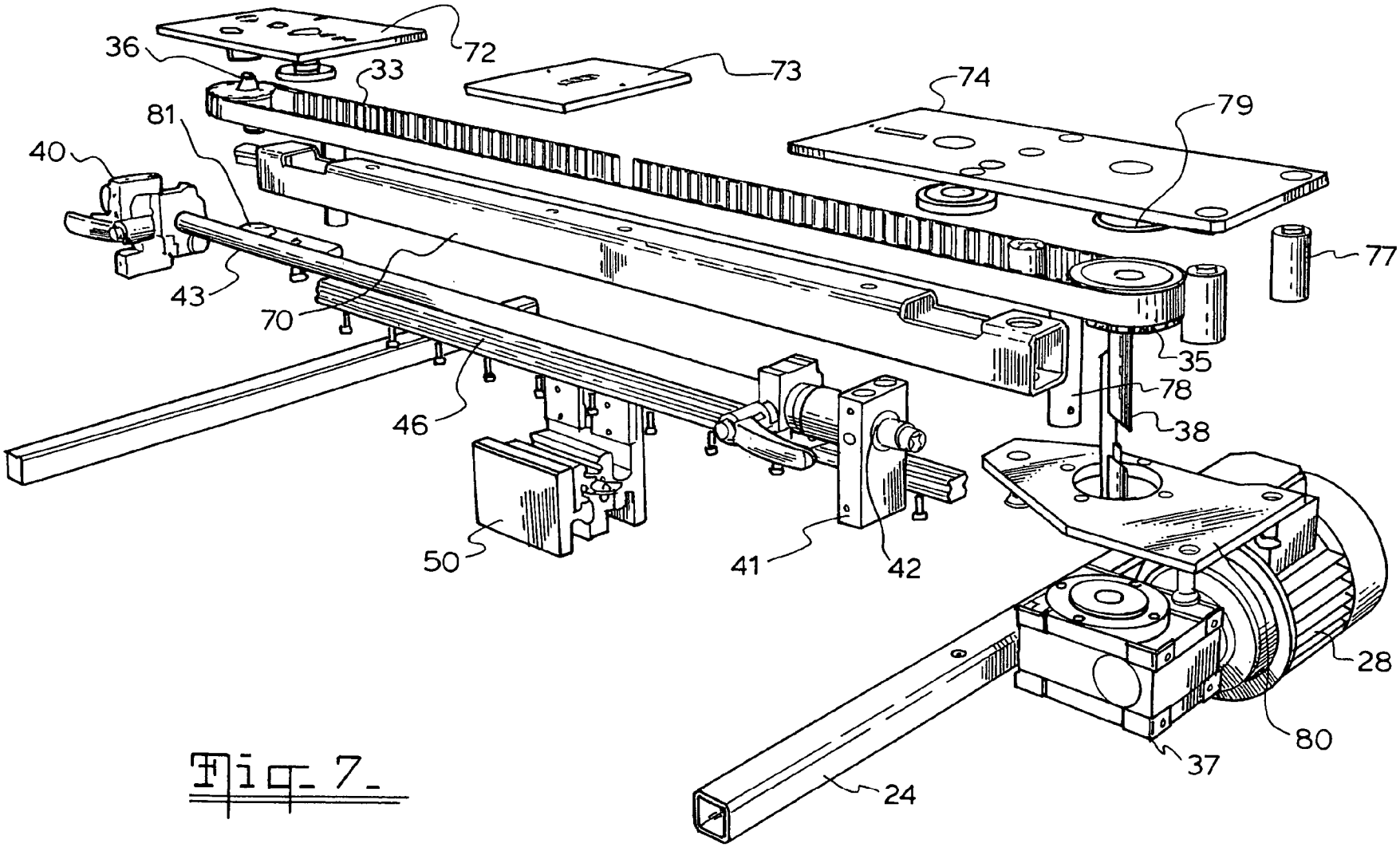
FIG. 7 is an exploded view of a second embodiment of this invention.

The micro registration is achieved using the micro registration adjustment levers 21 which extend into slots 39 in the support plate 31. As shown in FIG. 6 the micro registration levers 21 comprise a shaft 61 with an eccentric spigot 63 that extends into the slots 39. The shafts 61 are fitted into two press fitted spigotted bushes 62 mounted in the print arm 14. By adjusting the micro registration levers the position of plate 31 and thus the position of the print assembly 20 can be adjusted.

Figure 8:
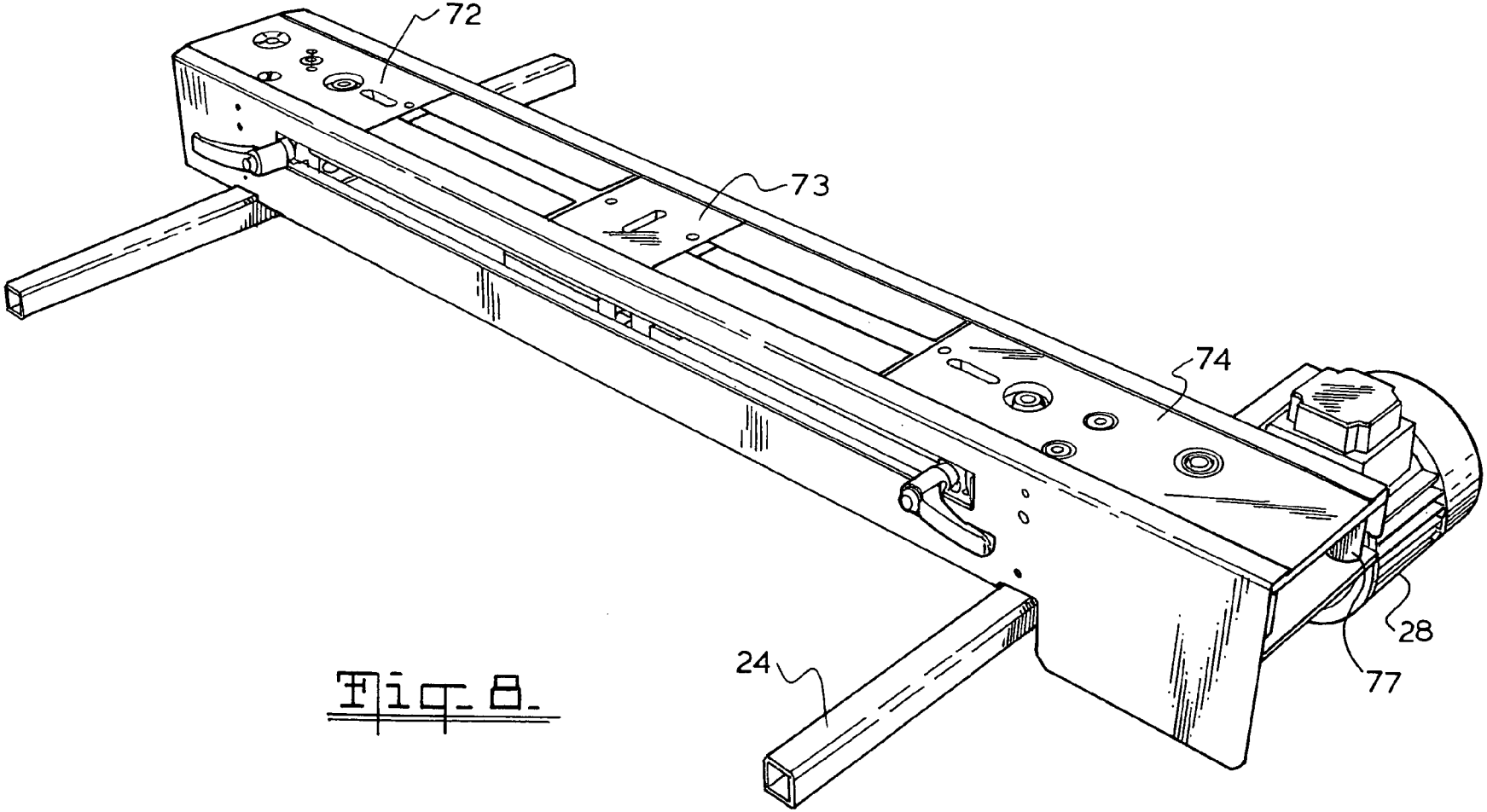
FIG. 8 is a view of the assembled print arm of FIG. 7.

In the alternative embodiment of this invention the single mounting plate is replaced with three mounting plates and a mounting channel to which the guide rail is also mounted. Items that are the same as the FIG. 4 embodiment have the same reference numerals. The mounting channel 70 extends between the drive pulley 35 and the idler pulley 36. The idler pulley is mounted on rhe support plate 81 which is also attached to the channel 70 the drive pulley is mounted on the drive shaft 38 of the gear box 37, which extends through the gearbox mounting plate 80, which is also attached to the channel 70. Attached to the top of the channel 70 are the three mounting plates 72, 73 and 74. The front plate 72 has the idler pulley 36 attached to it. The mid mounting plate 73 is adapted to carry the micro registration levers 21. The rear mounting plate 74 is attached to the gear plate 80 by the spacers 77 and carries the bearing 79 for the drive pulley 35. The screen support arm 24 is attached to the rear plate 74 by the spacer 78. When the arm is assembled a face plate 83 is attached to the front and rear plates 40 and 41 as shown in FIG. 8.

From the above it can be seen that this invention provides a unique print arm configuration that provides flexibility and ease in changing machine configurations. Those skilled in the art will appreciate that the teachings of this invention may be implemented in other embodiments without departing from the core concepts of the invention.

The invention claimed is:

1. A carousel screen printing machine of the type having radial print arms and radial pallet arms that rotate relative to the print arms, the print arms incorporating a detachable print carriage drive assembly from which the print carriage is suspended, said print carriage drive assembly including a) a longitudinal support frame member b) mounting plates attached to the support frame member at each end of the member c) an electric drive depending from one of said mounting plates d) a drive belt driven by said electric drive and mounted for horizontal movement around said support frame member; and the print carriage being mounted on the drive belt for reciprocal movement between the ends of said support frame member.

2. A carousel screen printing machine as claimed in claim 1 in which the support frame member is formed from a channel section.

3. A print drive assembly for a carousel screen printing machine including a) a longitudinal support frame member b) mounting plates attached to the support frame member at each end of the member c) an electric drive depending from one of said mounting plates d) a drive belt driven by said electric drive and mounted for horizontal movement around said support frame member; and the print carriage being mounted on the drive belt for reciprocal movement between the ends of said support frame member;

wherein the mounting plates, electric drive, drive belt and print carriage are removed as a unit with the commonly connected support frame member upon removal of the support frame member.

4. A print drive assembly as claimed in claim 3 in which the support frame member is formed from a channel section.

* * * * *